US007730681B2

(12) United States Patent
Gilleran

(10) Patent No.: US 7,730,681 B2
(45) **Date of Patent: *Jun. 8, 2010**

(54) AIR CONDITIONING LINE FLASHING PANEL

(76) Inventor: William J. Gilleran, 4129 Wagon Trail Ave., Las Vegas, CA (US) 89118

( * ) Notice: Subject to any disclaimer, the term of this patent is extended or adjusted under 35 U.S.C. 154(b) by 0 days.

This patent is subject to a terminal disclaimer.

(21) Appl. No.: 12/045,425

(22) Filed: Mar. 10, 2008

(65) Prior Publication Data

US 2008/0148654 A1 Jun. 26, 2008

Related U.S. Application Data

(60) Division of application No. 11/338,948, filed on Jan. 25, 2006, now Pat. No. 7,389,616, which is a continuation-in-part of application No. 10/768,591, filed on Jan. 30, 2004, now Pat. No. 7,305,801.

(60) Provisional application No. 60/515,310, filed on Oct. 29, 2003.

(51) Int. Cl.
*E04C 2/52* (2006.01)

(52) U.S. Cl. ..... 52/220.8; 52/219; 52/58; 52/61

(58) Field of Classification Search ..... 52/58, 52/60, 62, 63, 219, 220.1, 27, 36.4, 36.5, 52/220.8; 174/50, 60, 480, 481, 58
See application file for complete search history.

(56) References Cited

U.S. PATENT DOCUMENTS

| | | | | |
|---|---|---|---|---|
| 791,068 | A | 5/1905 | Baker | |
| 2,800,850 | A | 6/1957 | McKann | |
| 2,985,465 | A * | 5/1961 | Church | 285/42 |
| 3,651,245 | A | 3/1972 | Moll | |
| 3,683,305 | A | 8/1972 | Gray | |
| 3,936,589 | A | 2/1976 | Teeters et al. | |
| 3,955,701 | A | 5/1976 | Fisch | |
| 4,102,050 | A * | 7/1978 | Roth | 33/437 |
| 4,102,090 | A | 7/1978 | Anguish | |
| 4,135,337 | A | 1/1979 | Medlin | |
| 4,296,870 | A | 10/1981 | Balkwill et al. | |
| 4,473,244 | A | 9/1984 | Hill | |
| 4,526,407 | A | 7/1985 | Kifer | |

(Continued)

*Primary Examiner*—Richard E Chilcot, Jr.
*Assistant Examiner*—Jessica Laux
(74) *Attorney, Agent, or Firm*—Stetina Brunda Garred & Brucker

(57) ABSTRACT

A flashing panel mount for a plurality of air-conditioning lines of an air-conditioning unit located about an exterior of a building is provided. The plurality of air-conditioning lines defines an outer periphery. The panel mount may comprise a hood member and a cover. The hood member may be attachable to the building and may have a hood member aperture sized and configured to accommodate at least two of the plurality of air-conditioning lines so as to extend the air-conditioning lines from within the building to the air-conditioning unit located about the building exterior. The cover may be attached to the hood member aperture and may be sized and configured to accommodate the air-conditioning lines therethrough. The cover may be conformable to the outer periphery of the air-conditioning lines once the air conditioning lines are fed through the hood member aperture to prevent entrance of undesirable material from a building outside to a building inside.

8 Claims, 7 Drawing Sheets

U.S. PATENT DOCUMENTS

| | | | |
|---|---|---|---|
| 4,569,458 | A | 2/1986 | Horsley |
| 4,673,097 | A | 6/1987 | Schuldt |
| 4,757,158 | A | 7/1988 | Lentz |
| 4,794,207 | A | 12/1988 | Norberg et al. |
| 4,874,189 | A | 10/1989 | Gardner |
| 4,903,997 | A | 2/1990 | Kifer |
| 4,924,032 | A | 5/1990 | Akins |
| 4,927,039 | A | 5/1990 | McNab |
| 4,952,754 | A | 8/1990 | Rye |
| 4,965,971 | A | 10/1990 | Jean-Jacques et al. |
| 5,012,043 | A | 4/1991 | Seymour |
| 5,171,939 | A | 12/1992 | Shottey |
| 5,199,784 | A | 4/1993 | Hempleman |
| 5,246,255 | A | 9/1993 | Forbes et al. |
| 5,287,665 | A | 2/1994 | Rath, Jr. |
| 5,309,579 | A | 5/1994 | Nelson |
| 5,402,902 | A | 4/1995 | Bouley |
| 5,526,619 | A | 6/1996 | Bagedes |
| 5,664,955 | A | 9/1997 | Arnett |
| 5,740,936 | A | 4/1998 | Nash |
| 5,803,508 | A | 9/1998 | Lowella |
| 5,886,295 | A | 3/1999 | Carino et al. |
| 5,918,431 | A | 7/1999 | Schiedegger et al. |
| 5,931,325 | A | 8/1999 | Filipov |
| 5,946,863 | A | 9/1999 | Bullard |
| 5,965,844 | A | 10/1999 | Lippa |
| 6,239,365 | B1 | 5/2001 | McEvers |
| 6,384,334 | B1 | 5/2002 | Webb |
| 6,395,984 | B1 | 5/2002 | Gilleran |
| 6,404,132 | B1 | 6/2002 | Krumholz |
| 6,534,709 | B2 | 3/2003 | English |
| 6,608,253 | B1 | 8/2003 | Rintz |
| 6,649,835 | B2 | 11/2003 | Gilleran |
| 6,668,852 | B1 | 12/2003 | Williamson |
| 6,774,307 | B2 | 8/2004 | Kruse et al. |

* cited by examiner

AIR CONDITIONING LINE FLASHING PANEL

CROSS-REFERENCE TO RELATED APPLICATIONS

This application is a divisional of U.S. patent application Ser. No. 11/338,948 entitled AIR CONDITIONING LINE FLASHING PANEL filed Jan. 25, 2006 now U.S. Pat. No. 7,389,616, which is a continuation-in-part application of application Ser. No. 10/768,591 filed Jan. 30, 2004, now U.S. Pat. No. 7,305,801 issued Dec. 11, 2007 entitled AIR CONDITIONING LINE FLASHING PANEL which claims the benefit of U.S. Provisional Application No. 60/515,310, filed Oct. 29, 2003, the entirety of the disclosures of which are expressly incorporated herein by reference.

STATEMENT RE: FEDERALLY SPONSORED RESEARCH/DEVELOPMENT

Not Applicable

BACKGROUND

The present invention relates generally to exterior wall mount flashing for extending air conditioning lines through a wall of a building, and more particularly to an air conditioning flashing panel mount which provides a plurality of apertures adapted to receive a refrigerant and/or electrical control line of an air conditioning system through a wall of a residential and/or commercial building so as to eliminate any access into the building by unwanted intrusions such as air, water, rodents and/or the like.

As is commonly known, air conditioners typically use the evaporation of a refrigerant, like Freon, to provide air cooling. For example, conventional window mounted air conditioners have traditionally been utilized in small indoor spaces (e.g., one-bedroom apartment). This type of air conditioner is made small enough to fit into a standard window frame. The air conditioner is then operated for cooling in which its fan blows air over its condenser coils to deliver cold air to the indoor space.

Although conventional window air conditioners are suitable for small indoor spaces, they are not, however, effective or efficient for cooling larger indoor spaces such as a residential house or a commercial building. As such, central air conditioners are typically used for larger residential houses and commercial buildings. The central air conditioner is a more efficient way to cool such larger indoor spaces by providing controlled flow of chilled air through the air ducts of a conventional forced-air heating/cooling system.

As is known, central air conditioners include a compressor typically installed outside the residential house or commercial building and a condenser typically located inside the building and resident within a conventional forced air heating and ventilation system.

Typically, the compressor of the central air conditioner is placed on a concrete pad located outside the residential house or commercial building. It is connected to the condenser disposed within forced-air heating system located inside the house or by a number of air conditioning lines/conduits which extend through a section of an exterior wall of the building. More specifically, two refrigerant lines (typically copper lines for supplying/delivering a compressed refrigerant gas) and a control line (electrical line for selectively activating the compressor and fan of the air conditioning system) extend between the outside-located compressor and the inside-located condenser of the forced-air heating system.

As specifically illustrated in FIG. 1, an exterior roof jack flashing 10 is typically utilized in the prior art for extending the refrigerant lines 12 and the control line 14 through a particular exterior wall section 16 of a residential house or commercial building 18. Essentially, the roofjack flashing or vent pipe flashing 10 conventionally used by the construction and home-improvement industries features a conically shaped sheet metal body 20 which protrudes outwardly through the outer surface 22 of the wall section 16 and provides a single enlarged opening 24 leading to the inside of the house or building 18. By providing such access through the wall section 16, the two refrigerant lines 12 and the control line 14 may be run through the single enlarged opening 24 for extension between the air conditioner compressor and condenser.

However, due to its extensive size and outside dimensions, the opening 24 of the roof jack flashing or vent pipe flashing 10 remains substantially open, i.e., unfilled, despite the number of air conditioning lines 12, 14 passing therethrough. This makes the inside of the house or building 18 very vulnerable to undesirable elements such as air, moisture or rodents entering from outside. As will be recognized, this poses a significant problem since the air, moisture, rodents and the like may damage the structural integrity and/or the aesthetic appearance of the house or building 18, not to mention providing a substantial health risk to occupants.

In an attempt to alleviate this problem, it has been a common practice in the field to simply push a rag or fabric matting 26 around the lines to block the opening 24. More particularly, the rags or fabric matting 26 are typically dipped in a sealant such as tar and pushed into the opening 24 to fill the spacing surrounding the air conditioning lines 12, 14. As an alternative method, foam adhesive tapes or HVAC tapes, i.e. duct tapes, were also used to seal off the opening 24.

Although such method has proved to be somewhat effective initially in sealing the opening 24, it is significantly deficient to seal the opening over time. More specifically, due to it's fabric structure, the rag or matting 26 tends to degrade over time. This is also the same for the foam adhesive tapes, i.e. duct tapes, which tend to degrade over time. Further, the pliability or flexibility of the rag or matting 26 allows shifting from its original sealing positions when the exterior wall vent 10 is inadvertently contacted.

As such, the initial seal of the opening 24 can be eventually breached over time which may expose the inside of the house or building 18 to unwanted outside elements such as air, rodents and moisture. The breach in the opening's seal may not be discovered until the results of the exposure have already occurred. This usually leads to problems such as internal water damage or rodent infestation. Moreover, any attempt to remedy the breach may cause unintentional damage to the exterior finish (e.g., stucco, wood siding or paint) of the residential house or commercial building 18.

In view of the above-described shortcomings of conventional exterior roof jack flashing or vent pipe flashing, there exists a need in the art for an exterior wall mount flashing that can optimally seal off any opening or access to the inside of a house or a building while extending each of the air conditioning lines therethrough. More specifically, there exists a need for an exterior wall mount which can maintain such seal continuously over time so as to prevent any unwanted intrusions by air, water, rodents and/or the like into the house or building.

BRIEF SUMMARY

The present invention specifically addresses and alleviates the above-referenced deficiencies associated with the use of the exterior roof jack flashing of the prior art. More particularly, the present invention comprises an improved air conditioning flashing panel mount which provides a plurality of panel apertures adapted to preferably accommodate a separate line of an air conditioning system through a wall of a residential and/or commercial building. By providing multiple panel apertures that can closely fit and seal their respective air conditioning lines extending therethrough, the flashing panel mount of the present invention eliminates the need for a single enlarged opening characterized in conventional prior art exterior wall mounts. This effectively prevents any unwanted intrusions from the outside environment such as air, water, rodents and/or the like from coming into the inside of the residential and/or commercial building.

In accordance with a first preferred embodiment of the present invention, there is provided an air conditioning flashing panel mount adapted to provide a generally water proof physical seal of the air conditioning lines extending into the residential and/or commercial building. The flashing panel mount of the first preferred embodiment first features a substantially flat and generally rigid or semi-rigid panel. This panel is sized and configured to be attached to a wall of the building adjacent to an exteriorly located air conditioning unit or compressor. A second surface of the panel is abutted directly against the frame of the exterior wall (e.g., wood or metal studs) in which conventional fasteners such as nails are driven through the first surface thereof for attachment to the wall frame.

In the first preferred embodiment of the present invention, the flashing panel mount of the present invention also features a hood member. This hood member extends outwardly from the first surface of the panel, and more preferably extends out from about the central portion of the panel. The hood member is preferably made from the same material which is used to fabricate the panel. A recess is formed within the hood member which is sized and configured to be accessed only through a second surface of the panel. More specifically, an opening is provided at the second panel surface for exposing the panel recess through that surface.

Formed through the lower surface of the hood member are a plurality of panel apertures, each preferably adapted to accommodate a respective one of the air conditioning lines therethrough. Each of the panel apertures provide a pathway in which the air conditioning lines can be extended through the flashing panel mount. The panel apertures are preferably sized to closely fit the diameter size of their respective air conditioning lines.

In the first preferred embodiment of the present invention, a sealing member may additionally be provided on each aperture. Each sealing member preferably comprises an elastomeric sheet or rubber grommet which is positioned around an circumferential edge that forms the respective panel aperture.

There is further provided an air conditioning flashing panel mount which is constructed in accordance with a second preferred embodiment of the present invention. The flashing panel mount of the second preferred embodiment is designed to perform the identical function as that of the first embodied panel mount. However, its structure and the manner of use are slightly modified.

In particular, the flashing panel mount of the second preferred embodiment is attached to the wall of the building in a reverse orientation. More particularly, the first surface of its panel is abutted directly against the frame of the wall so that fasteners such as nails, can be driven through the second panel surface for attachment to the wall frame. By such reverse attachment, its hood member is no longer extending outwardly from the building but rather is disposed within the interior portion of the wall frame.

Unlike the first embodiment, the panel apertures are formed through the upper hood surface rather than through the lower hood surface. Further unlike the first embodiment, a flanged frame is provided around the recess opening in order to prevent any water or moisture from entering the panel recess. The flanged frame surrounds the recess opening, and is preferably placed immediately around the opening's edge.

With the structure defined, the operation of the air conditioning flashing panel mount of the first embodiment is described herein to essentially illustrate the operation of the flashing panel mount of the second embodiment as well. Initially, a user (e.g., construction worker) fastens (via nails, for example) the panel mount onto the selected section of the building's exterior wall. Of course, in the case of the flashing panel mount of the second embodiment, the orientation of its attachment would be reversed.

The two refrigerant lines and the single electrical control line are brought through the wall and into the panel recess through its recess opening. Thereafter, the air conditioning lines are inserted through the respective panel apertures formed at the lower hood surface so as to be extended fully through the flashing panel mount of the first embodiment. They are then connected to the air conditioning unit or compressor located outside the building and connected therewith. In the flashing panel mount of the second embodiment, the air conditioning lines are first inserted through the panel apertures formed at the upper hood surface and then extended out of the panel recess through its recess opening. Any exposed portions of the refrigerant lines may be optionally wrapped or surrounded by an insulation padding.

Once the air conditioning flashing panel mount becomes mounted and installed, a first layer of lath paper is then brought from below and positioned underneath the panel up to the bottom edging forming the recess opening. In addition, a second layer of lath paper is brought from above and placed over the panel to cover its surface with the exception of the outwardly extending hood member. Upon such application of lath papers, lath and stucco or conventional siding is used over the second layer of lath paper in order to finish the installation of the exterior wall. By incorporating such flashing panel mount into the structure of the building, any access created by the air conditioning lines can now be effectively eliminated so as to deter the problems associated therewith.

There is further provided air conditioning flashing panel mounts which are constructed in accordance with a third preferred embodiment and a fourth preferred embodiment of the present invention. The flashing panel mounts of the third and fourth preferred embodiments are designed to perform the identical function as that of the first and second embodied panel mounts. However, their structure and the manner of use are slightly modified.

Both the third and fourth embodiments of the flashing panel mount may comprise a panel, hood member and a cover member. The panels of the third and fourth embodiments mounts the panel mounts to a wall of the building in a similar manner as the panels of the second and first embodiments, respectively.

The hood member provides an opening for at least two air-conditioning lines to be fed therethrough. In this respect, the third and fourth embodiments of the flashing panel mounts are different compared to the first and second embodiments of the flashing panel mounts. In the first and second embodiments, each of the air conditioning lines are fed through a respective one of a plurality of panel apertures. In contrast, in the third and fourth embodiments of the flashing panel mounts, one opening or aperture provided by the hood member may be sized and configured to receive at least two of the air conditioning lines. For example, in a typical air conditioning system, two refrigerant lines may be fed through a first opening and one control line may be fed through a second opening. More preferably, the aggregate of air conditioning lines (e.g., two refrigerant lines and one control line) are fed through one opening.

The cover member is sized and configured to be attached to the opening of the hood member and conformable to the outer periphery of the aggregated air-conditioning lines fed through the opening. Since the cover member conforms to the outer periphery of the air conditioning lines, the cover member seals off the opening of the hood member to prevent undesirable rodents, trash and air from entering into the building.

The difference between the third and fourth embodiments of the flashing panel mounts is that the flashing panel mount of the third embodiment is mounted to the wall such that the hood member is oriented in toward the interior of the building and the opening for receiving the air conditioning lines is directed upward similar to the second embodiment. In contrast, the flashing panel mount of the fourth embodiment is mounted to the wall such that the hood member is oriented out toward the exterior of the building and the opening for receiving the air conditioning lines is directed downward similar to the first embodiment.

BRIEF DESCRIPTION OF THE DRAWINGS

These as well as other features of the present invention will become more apparent upon reference to the drawings wherein.

DETAILED DESCRIPTION

Figure 1:
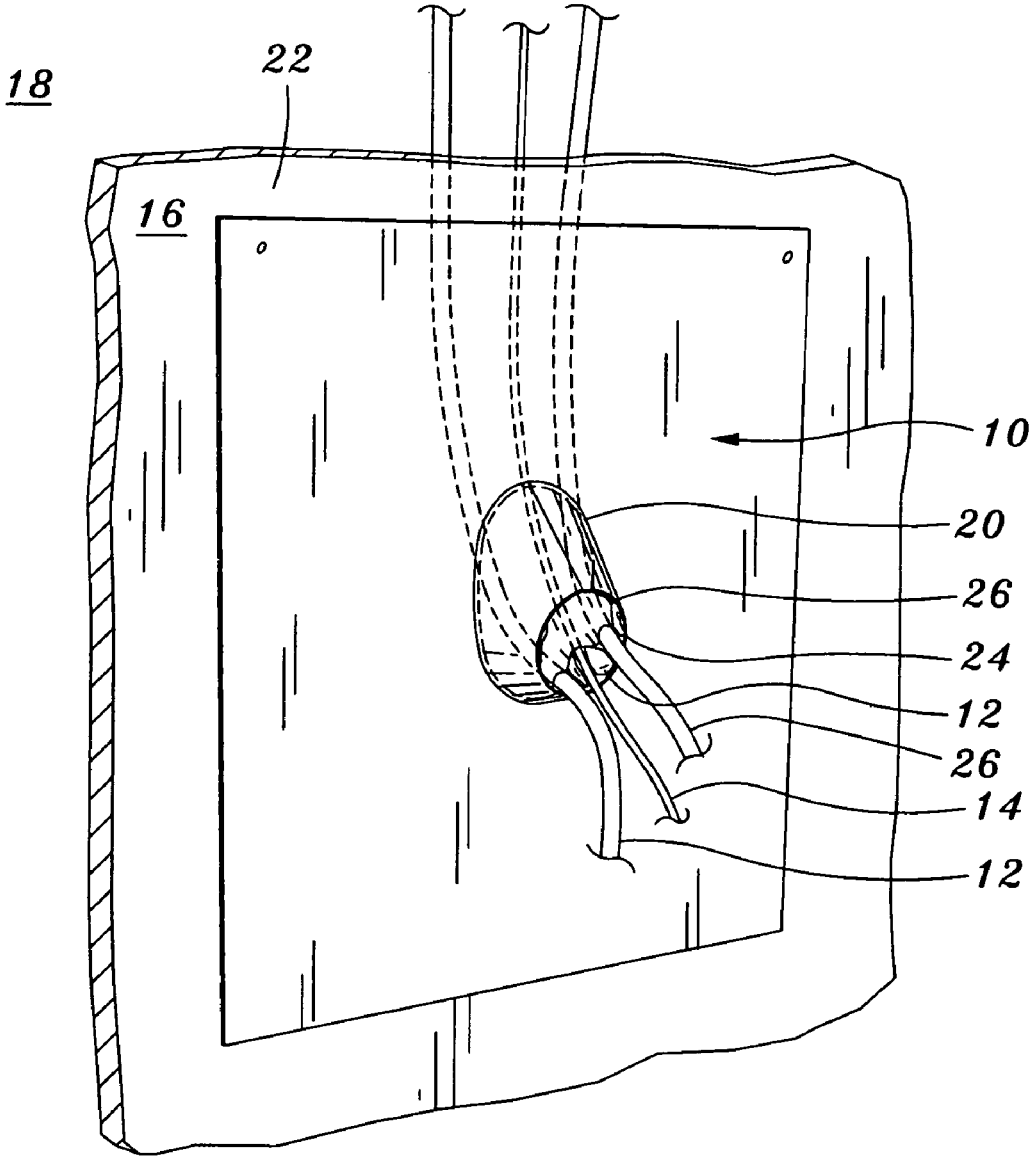
Fig. 1 (PRIOR ART)
FIG. 1 is a perspective view of a prior art exterior roof jack flashing or vent pipe flashing conventionally used for extending the air conditioning lines through a wall of a residential and/or commercial building.
Figure 2:
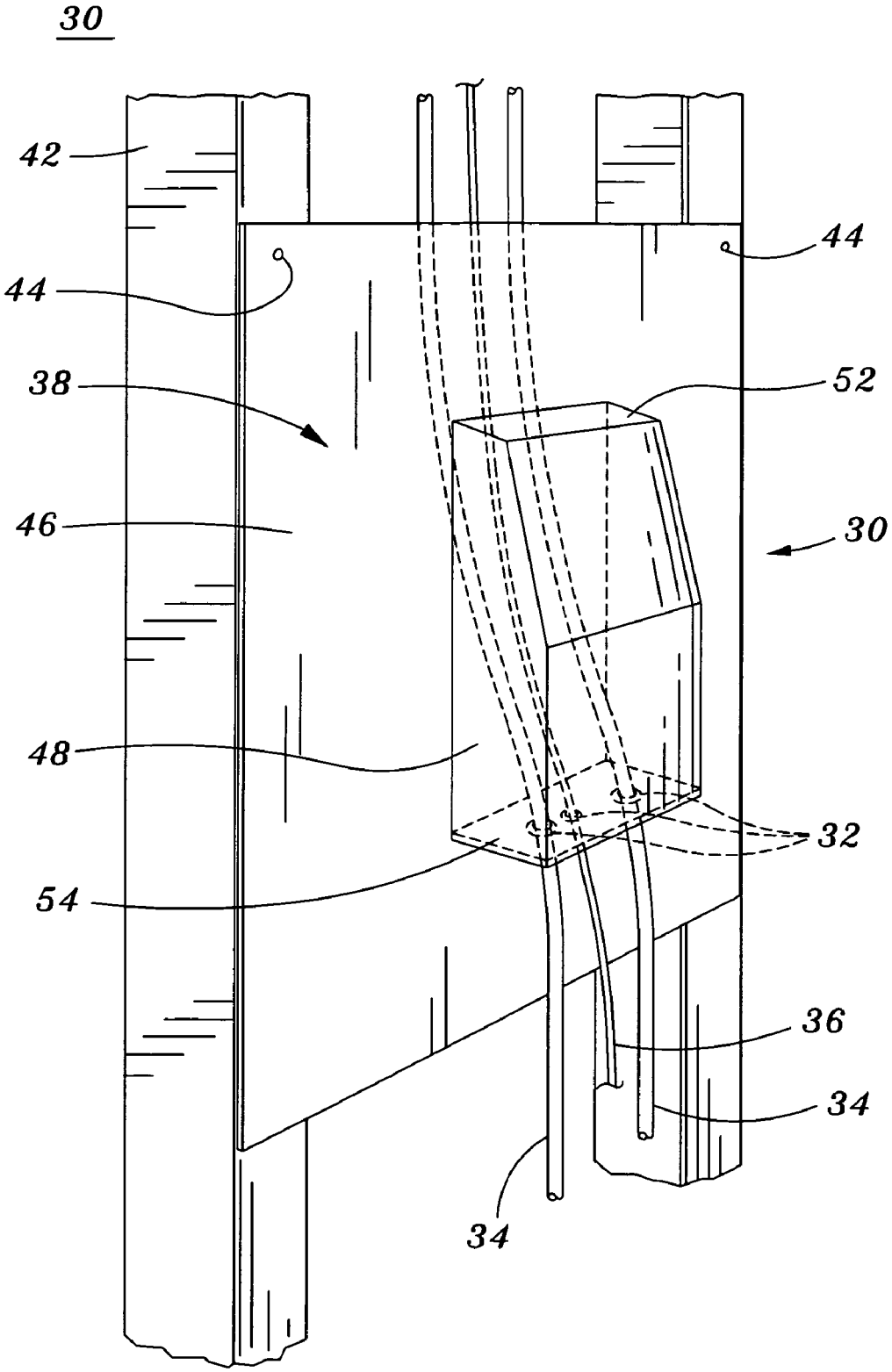
FIG. 2 is a perspective view of an air conditioning line flashing panel mount constructed in accordance with a first preferred embodiment of the present invention and illustrating a hood member which extends outward from its first surface.

Referring now to the drawings wherein the showings are for purposes of illustrating preferred embodiments of the present invention only, and not for purposes of limiting the same, FIG. 2 perspectively illustrates an air conditioning flashing panel mount 30 constructed in accordance with a first preferred embodiment of the present invention. As indicated above, the present flashing panel mount 30 provides a plurality of panel apertures 32 each adapted to accommodate a separate line of an air conditioning system through a wall 16 of a residential and/or commercial building 18. By providing multiple panel apertures 32 that can closely fit and seal their respective air conditioning lines 34, 36 extending therethrough, the present flashing panel mount 30 eliminates the prior art feature of a single enlarged opening that characterizes the conventional exterior wall mounts 10. As will be soon discussed, this effectively prevents any unwanted intrusions from the outside environment such as air, water, rodents and/or the like from coming into the inside of the residential and/or commercial building.

Before proceeding with the substantive explanations of the present invention, it is important to clarify certain terminologies used herein for the purpose of better understanding the present invention. First, the term "residential building" used throughout this section should not be construed narrowly, but rather broadly to mean any type of facility which is intended for residential purposes. Examples of such facilities include, but are not limited to, residential houses, apartments, condominiums, cabins, trailer homes and the like. Furthermore, the term "commercial building" should also be interpreted broadly to include any facility that is intended for purposes other than for residence such as hotels, motels, retail stores, office buildings, factory buildings and the like.

Figure 3:
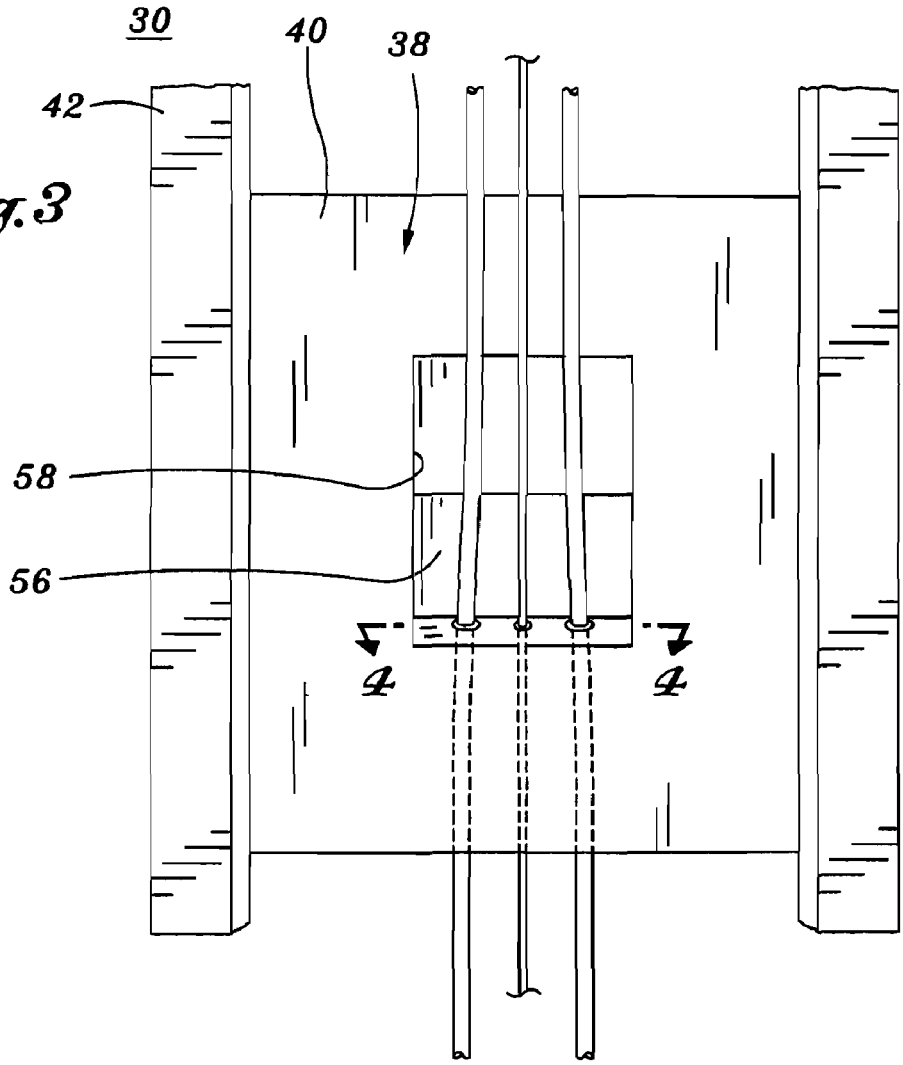
FIG. 3 is a rear view of the flashing panel mount shown in FIG. 2 and illustrating a plurality of air conditioning lines extending through a respective one of the panel apertures formed at the lower surface of the hood member.
Figure 4:
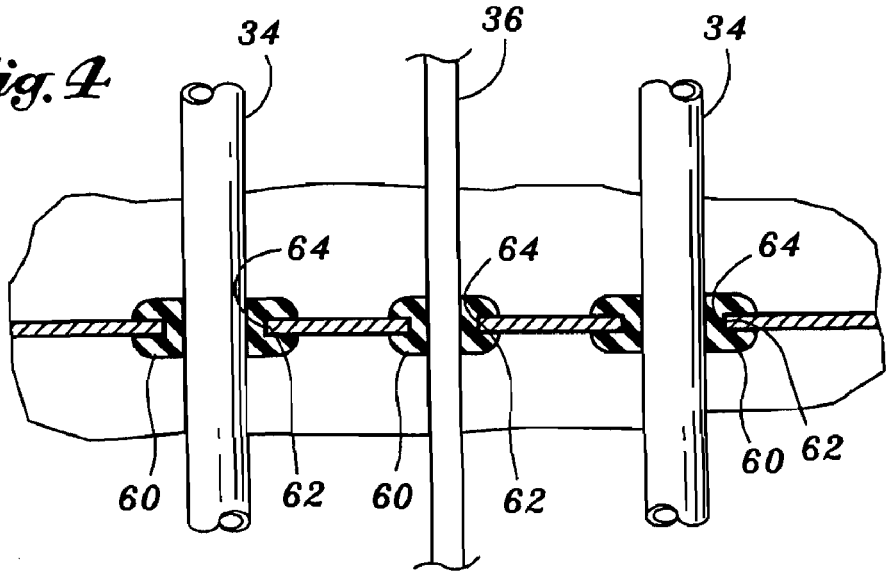
FIG. 4 is a cross-sectional view of the panel apertures shown in FIG. 3 and illustrating a plurality of sealing members each positioned around their respective panel apertures.

Referring more particularly to FIGS. 2-4, the air conditioning flashing panel mount 30 of the first preferred embodiment includes a panel 38 adapted to be attached to the wall 16 of the building 18 which is adjacent to an exteriorly located air conditioning unit or compressor (not shown). More specifically, a second surface 40 of the panel is abutted directly against frames 42 of the wall 16 (e.g., wood studs) or plywood shear wall (not shown) in which fasteners 44 such as nails, screws or staples are driven through the first surface 46 thereof for attachment to the wall frames 42. As such, the first panel surface 46 is faced away from the building 18 when the panel 38 is attached thereto. Of course, the second panel surface 40 would face toward the building 18.

This panel 38 may be fabricated from any material which can provide semi-rigidity or rigidity after fabrication such as sheet metal or plastic. However, plastic is the material of choice as it can be easily molded to form a one-piece panel. Although the panel 38 may possess various configurations and sizes, it is preferably flat and rectangular in configuration, and has a size which is sufficient to create an enlarged moisture-impervious perimeter around the air conditioning lines 34, 36.

The flashing panel mount 30 of the first preferred embodiment also features a hood member 48 which extends outward from the first surface 46 of the panel 38. Although such hood member 48 may be outwardly extended from any location of the first panel surface 46, it is preferred that the hood member 48 extends out from about the central portion of the panel 38 so that the water-impervious perimeter formed by the panel 38 is evenly set around the hood member 48. Preferably, the hood member 48 is made from the same material which is used to fabricate the panel 38. The hood member 48 of the first preferred embodiment may be formed to have various configurations and shapes. Preferably, however, it is generally rectangular in configuration so as to define substantially planar upper and lower hood surfaces 52, 54, the significance of which will be described later.

The interior of the hood member 48 is substantially hollow and void. Hence, a recess 56 is formed within the hood member 48 which can be accessed only through the second surface 40 of the panel 38. More specifically, an opening 58 is provided at the second panel surface 40 for exposing the panel recess 56 through that surface 40. Even though the recess opening 58 may be sized to only partially expose the panel recess 56, it is preferred that the size of the opening 58 is substantially equivalent to that of the panel recess 56 so as to fully expose the panel recess 56 therethrough.

Formed through the lower surface 54 of the hood member 48 are a plurality of panel apertures 32 each specifically adapted to accommodate a respective one of the air conditioning lines 34, 36 therethrough. Each of the panel apertures 32 communicate with the panel recess 56 which is exposed through the recess opening 58. This provides a series of pathways in which the air conditioning lines 34, 36 can be extended through the flashing panel mount 30 of the first preferred embodiment.

Although not by way of limitation, the number of panel apertures 32 provided is preferably identical to the number of the air conditioning lines 34, 36 that need to extend through the wall 16 of the building 18. In this respect, there are three panel apertures 32 to accommodate the two refrigerant lines 34 and the electrical control line 36 that are elongated between the exteriorly-located air conditioning unit or compressor and the interiorly-located forced-air heating system (not shown).

The panel apertures 32 are preferably sized to closely fit the diameter size of their respective air conditioning lines 34, 36. Thus, the panel apertures 32 intended for the refrigerant lines 34 would be larger in size than the panel aperture 32 intended for the electrical control line 36. By conforming the aperture sizes to the line sizes, it significantly reduces any spacing between the panel apertures 32 and their respective air conditioning lines 34, 36. This lessens the amount of access into the residential and/or commercial building 18.

Referring now to FIGS. 3 and 4, a sealing member 60 may be provided to seal off each aperture 32 while allowing the respective air conditioning line 34 or 36 to pass through. Each sealing member 60 is preferably a grommet which is positioned around an aperture edging 62 that forms the respective panel aperture 32. More specifically, each of the grommets has a groove 64 which captures the edge 62 of their respective panel apertures 32 so as to be fixed in position. Preferably, the grommets are each fabricated from an elastomeric material such as rubber so as to protect the structural integrity of both the aperture edgings 62 and the lines 34, 36 passing therethrough.

Alternatively, it should be noted that the lower surface 54 of the hood member 48 may be formed of a stretchable sheet or membrane. Such sheet or membrane may be fabricated from various types of stretchable material. One type of such material is an elastomeric material such as rubber. In this regard, slits or holes may be created directly through the lower surface 54 which may simulate the panel apertures 32 upon stretching the sheet or membrane. This may be accomplished simply by cutting through the lower surface 54 with a cutting tool, or the lower surface may be pre-cut or scored, or any of the like procedures. This would eliminate the need for using sealing members 60 such as grommets around the panel apertures 32.

Figure 6:
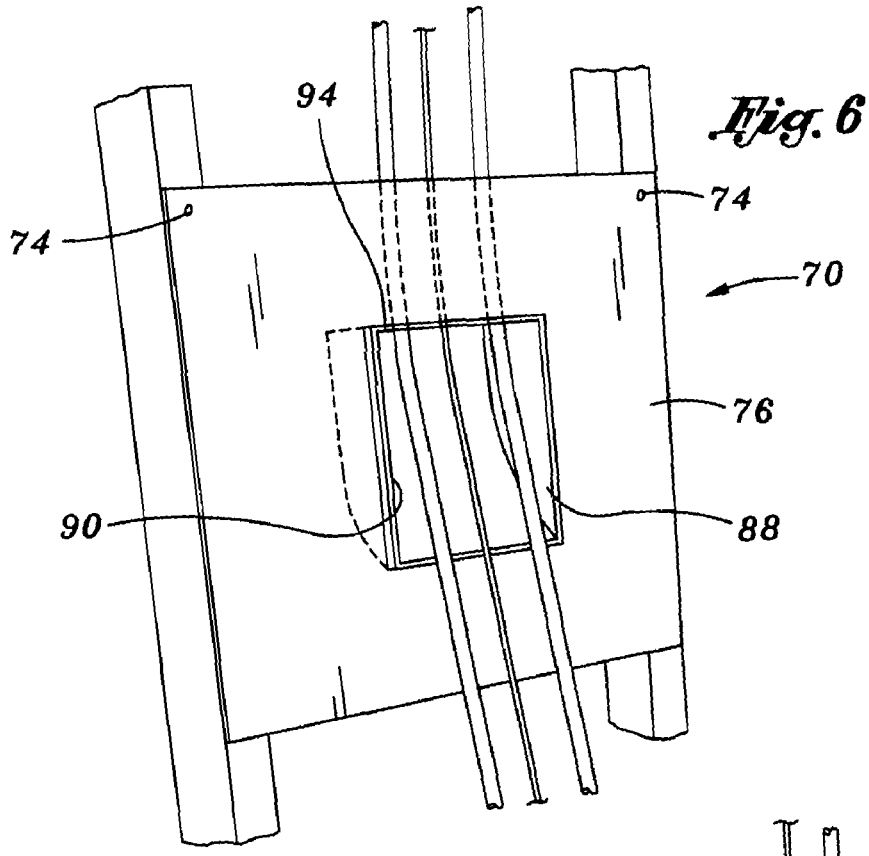
FIG. 6 is a perspective view of an air conditioning flashing panel mount constructed in accordance with a second preferred embodiment of the present invention and illustrating a panel recess which is exposed through its second surface via a recess opening.
Figure 7:
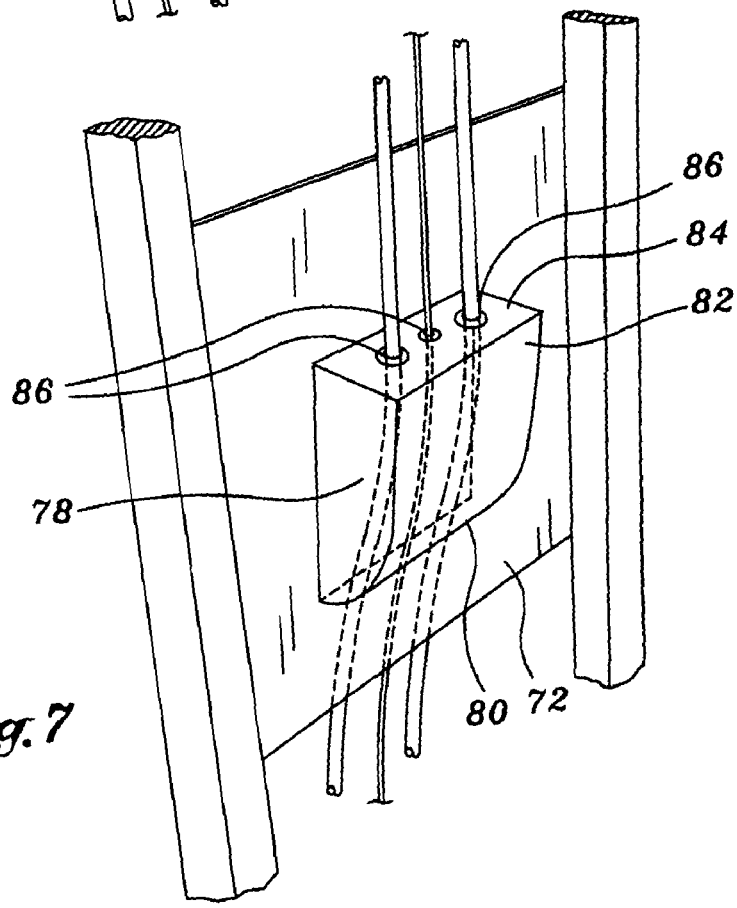
FIG. 7 is a rear view of the flashing panel mount shown in FIG. 6 and illustrating a hood member extending outward from its first surface and including a plurality of panel apertures formed at the upper surface thereof.

Referring now to FIGS. 6 and 7, there is further provided an air conditioning flashing panel mount 70 which is constructed in accordance with a second preferred embodiment of the present invention. The flashing panel mount 70 of the second preferred embodiment is designed to perform the identical function as that of the version reflected in the first embodiment. However, its structure and the manner of use are slightly modified in comparison to the first version.

In particular, the flashing panel mount 70 of the second preferred embodiment is attached to the wall 16 of the residential and/or commercial building 18 in a reverse orientation. More particularly, the first surface 72 of its panel is abutted directly against the frames 42 of the shear wall 16 so that fasteners 74 such as nails can be driven through the second panel surface 76 for attachment to the wall frames 42. Consequently, the first panel surface 72 becomes faced toward the building 18 while the second panel surface 76 is faced away therefrom.

By such reverse attachment, its hood member 78 is no longer extending outward from the building 18 but rather extends inwardly within the wall. Although the hood member 78 of the second preferred embodiment may be shaped similar or identical to the first embodied hood member 48, the second hood member 78 is different in that its shaping is more of a half accurate configuration rather than a general rectangular configuration. The hood member 78 tapers gradually outward from the first panel surface 72 from its lower portion 80 to its upper portion 82, thereby producing a planar surface 84 at the upper hood portion 82.

Unlike the first embodiment, the panel apertures 86 are formed through the upper hood surface 84, and not through the lower hood surface. However, similar to the first versioned panel apertures 32, the panel apertures 86 of the second embodiment are also placed in fluid communication with the panel recess 88 and share the size and shape which are consistent therewith. Further, the use of sealing members 60 for sealing the panel apertures 86 also applies here. In this respect, each of the air conditioning lines 34, 36 may be first extended from the inside of the building 18 through the respective panel apertures 86 so as to be led out of the panel recess 88 through its recess opening 90 for connection to the outside located air conditioning unit or compressor.

In order to prevent any water or moisture from entering into the outwardly faced panel recess 88, a flanged frame is provided around the recess opening 90. More specifically, the flanged frame is formed to be complimentary in shape to the edging 94 forming the recess opening 90. Hence, the flanged frame surrounds the recess opening 90, and is preferably placed immediately around the opening's edging 94. The flanged frame utilized in the second embodiment is preferably fabricated from the same material which was used for the manufacture of the panel mount 70. As such, the flanged frame deters any water or moisture which runs down the outer surface 22 of the wall 16 of the building 18 from entering into the panel recess 88 through its recess opening 90.

Figure 5:
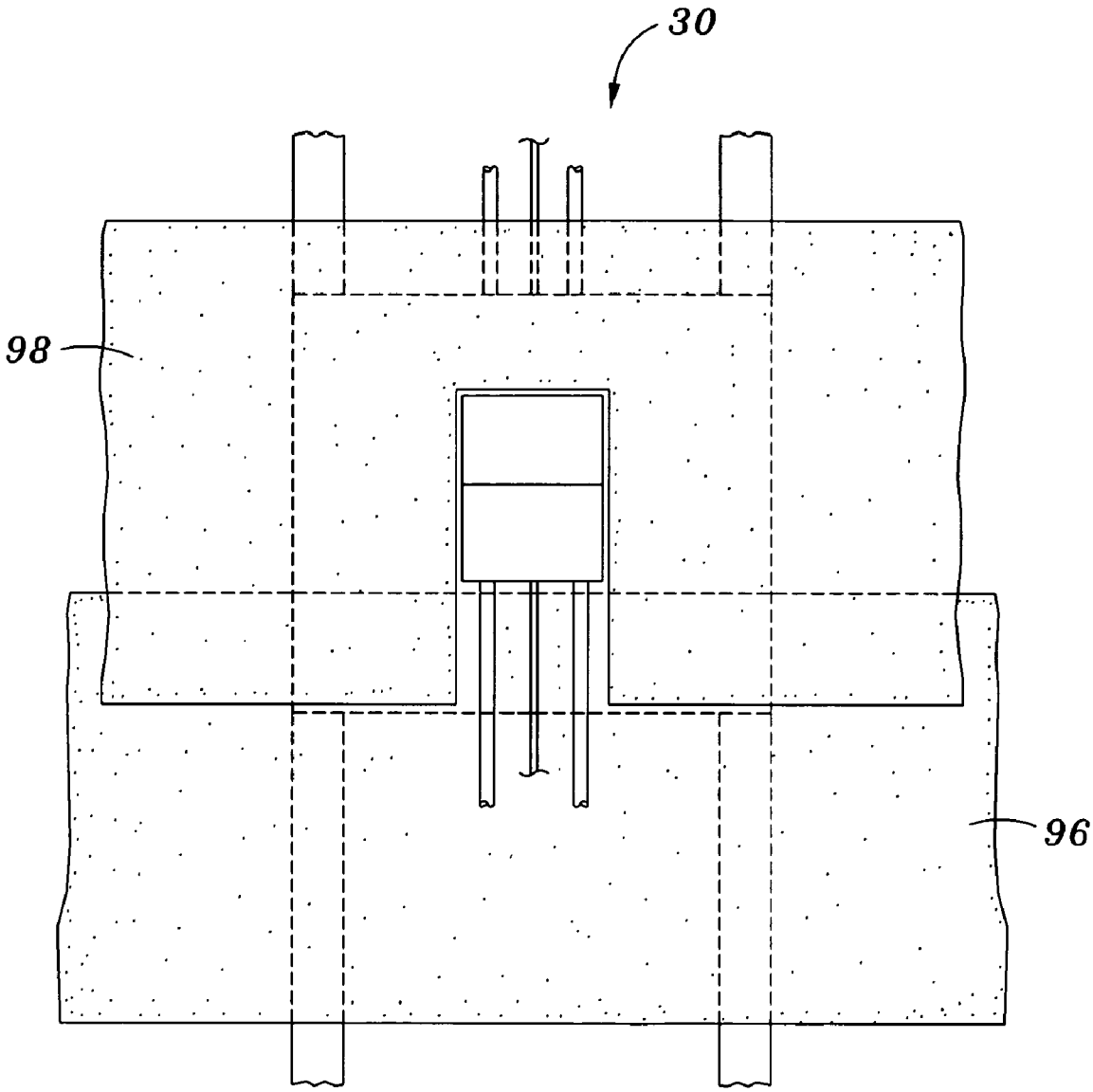
FIG. 5 is an elevation cut-away view of a wall portion of a building shown in FIG. 1 and illustrating the installation of the flashing panel mount of FIG. 2 with respect thereto.

Referring now to FIG. 5, the operation of the air conditioning flashing panel mount 30 of the first embodiment is described herein to essentially illustrate the operation of the flashing panel mount 70 of the second embodiment as well. The flashing panel mount 30 of the first embodiment is designed for the purpose of protecting the inside of a residential and/or commercial building 18 from any unwanted intrusions from outside such as rodents or water by sealing each of the air conditioning lines 34, 36 extending therethrough. Initially, a user (e.g., construction worker, etc.) fastens (via nails, for example) the panel mount 30 onto the selected exterior section of the building's wall 16 in a manner that its hood member 48 is faced outside and the panel recess 56 is faced inside. Of course, in the case of the flashing panel mount 70 of the second embodiment, the manner of its attachment would be reversed, as described above.

The two refrigerant lines 34 and the single electrical control line 36 are brought into the panel recess 56 through its recess opening 58. Thereafter, the air conditioning lines 34, 36 are inserted through the respective panel apertures 32 formed at the lower hood surface 54 so as to be extended fully through the flashing panel mount 30 of the first embodiment. They are then led to the air conditioning unit or compressor located outside the residential and/or commercial building 18 and connected therewith. As mentioned above in the description of the second embodied flashing panel mount 70, the air conditioning lines 34, 36 are first inserted through the panel apertures 86 formed at the upper hood surface 84 and then led out of the panel recess 88 through its recess opening 90. Any exposed portions of the refrigerant lines 34 may be optionally wrapped or surrounded by a thermal padding (now shown), preferably a foam padding.

Once the air conditioning flashing panel mount 30 becomes mounted and installed, a first layer of lath paper 96 is then brought from below and positioned underneath the panel 38 up to the bottom edge forming the recess opening 58. In addition, a second layer of lath paper 98 is brought from above the panel 38 to cover its surface 46 with the exception of the outwardly extending hood member 48. Upon such application of lath papers 96, 98, lath and stucco or conventional siding is used over the second layer of lath paper 98 in order to finish the installation of the exterior wall 16. By incorporating such flashing panel mount 30 into the structure of the building 18, any access created by the air conditioning lines 34, 36 can now be effectively eliminated so as to deter the problems associated therewith.

Figure 8:
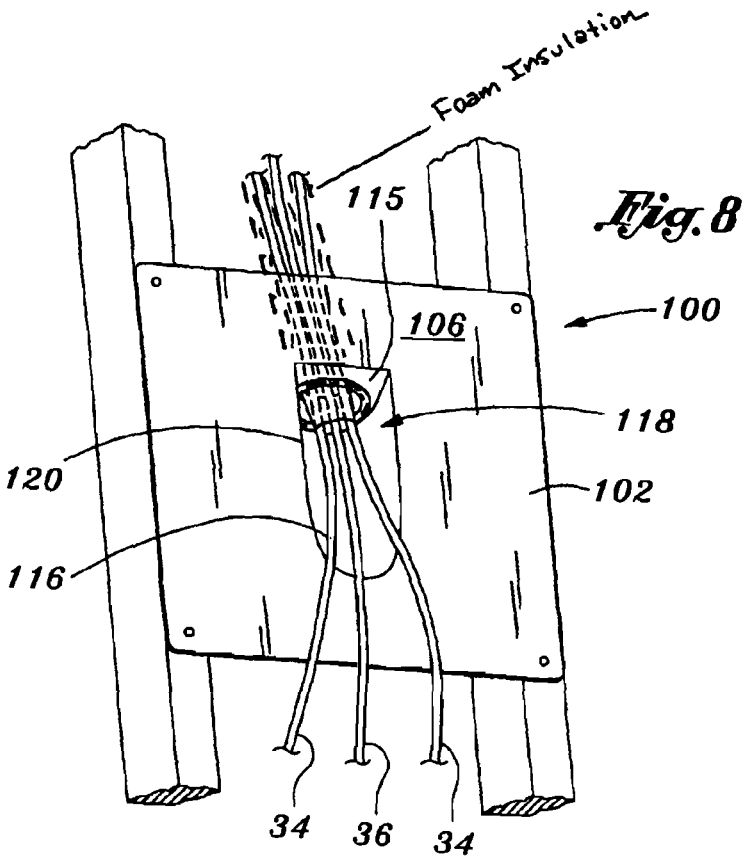
FIG. 8 is a perspective view of an air conditioning flashing panel mount constructed in accordance with a third preferred embodiment of the present invention and illustrating a hood member which extends in toward the interior of the building and a plurality of air conditioning lines extending through one aperture formed at the upper member of the hood member.
Figure 9:
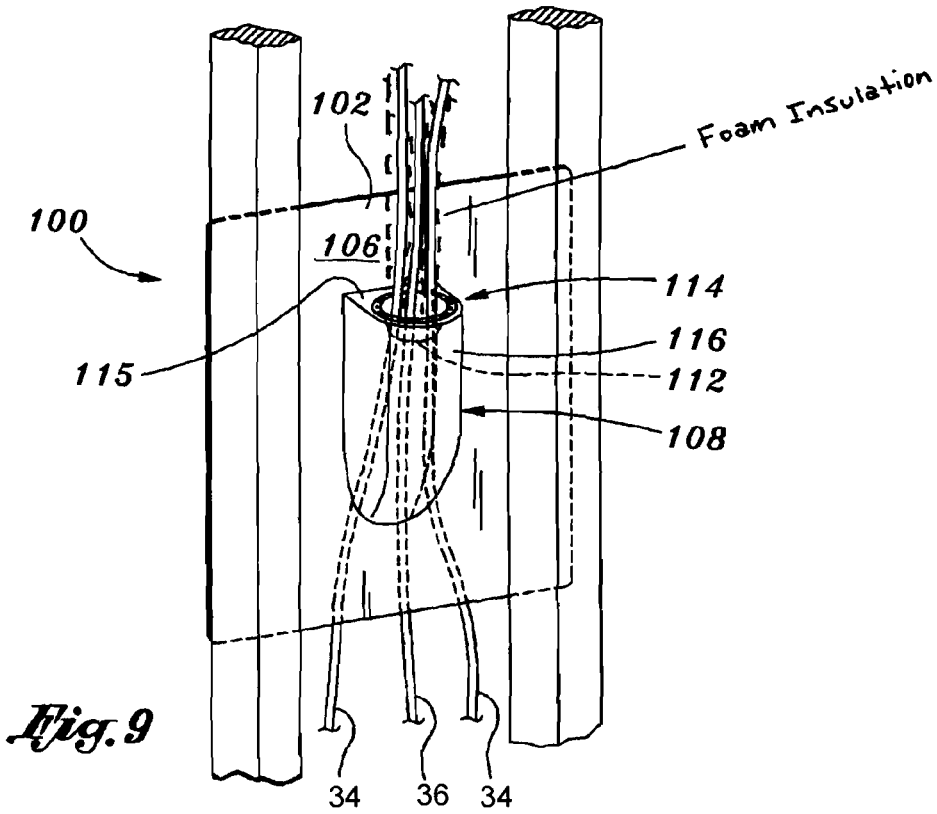
FIG. 9 is a rear view of the flashing panel mount shown in FIG. 8.
Figure 10:
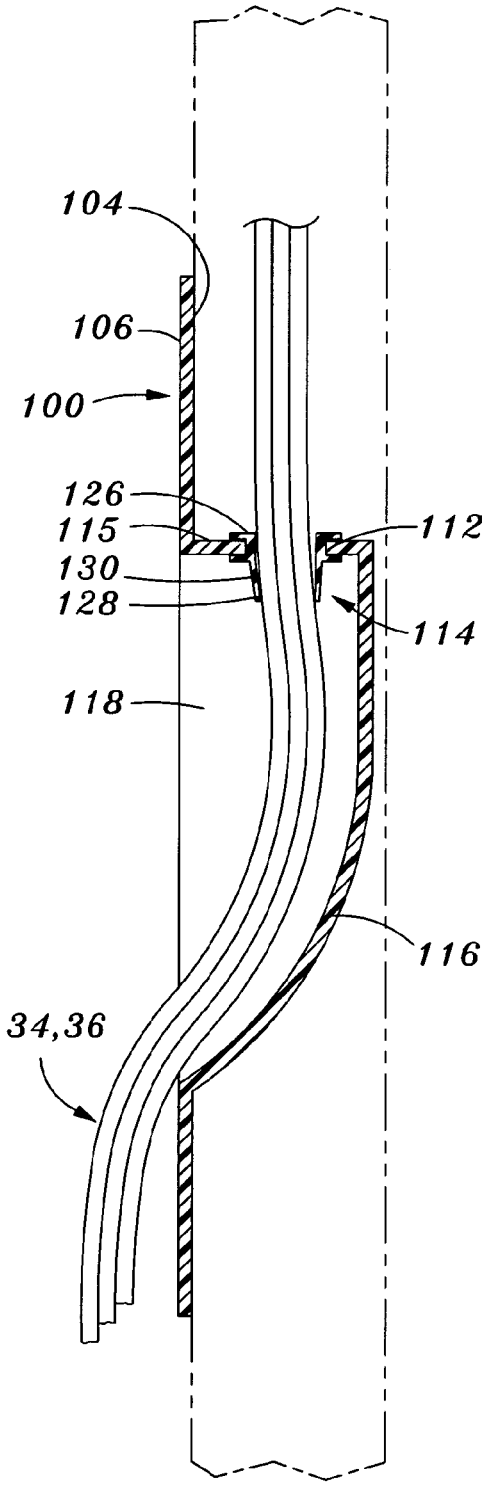
FIG. 10 is a cross sectional side view of the flashing panel mount shown in FIG. 8 and illustrating a cover being conformable to an outer periphery of the plurality of air conditioning lines.

Referring now to FIGS. 8-10, there is further provided an air-conditioning flashing panel mount 100 which is constructed in accordance with a third preferred embodiment of the present invention. The flashing panel mount 100 of the third preferred embodiment is designed to perform the identical function of as that of the versions reflected in the first and second embodiments. However, its structure and manner of use are slightly modified in comparison thereto.

In particular, the air-conditioning lines are not separated and inserted through respective panel apertures 32 and 86. Rather, the air-conditioning lines 34 and 36 may be bundled together and fed through a single line aperture 112. Undesirable air, rodents or trash are prevented from entering the building due to a cover 114 which is conformable to an outer periphery of the bundled air-conditioning lines 34 and 36, as best shown in FIG. 10. The cover 114 closely fits the outer periphery of the aggregate of air-conditioning lines and the spacing between the air-conditioning lines is insufficient for undesirable rodents and trash to enter into the building therethrough.

The air-conditioning flashing panel mount may comprise a panel 102 defining first and second surfaces 104 and 106. The first surface 104 may be attached to the wall 16 of the building in a similar manner compared to the second embodiment (see FIGS. 6 and 7), as shown in FIGS. 8-10.

The flashing panel mount 100 may also feature a hood member 108. Although such hood member 108 may extend from any location of the first surface 104, it is preferred that the hood member 108 extends out from about a central portion of the panel 102 so that a water-impervious perimeter formed by the panel to the building wall 16 is evenly set around the hood member 108. Preferably, the hood member 108 is made from the same material which is used to fabricate the panel 102 although the hood member 108 may have various configurations and shapes. Preferably, the hood member 108 has a generally flat upper member 115 that extends out from the first surface 104. From a periphery of the upper member 115, a lower member 116 curves downward and blends or tapers into the first surface 104 of the panel 102. In this manner, rain that falls on the panel 102 cascades downward from the panel 102 to the inner surface of the lower member 116 and onto the ground.

The interior of the hood member 108 is substantially hollow and void, as shown in FIGS. 8 and 10. Hence, a recess 118 is formed within the hood member 108 which can be accessed only through the second surface 106 of the panel 102. More specifically, an opening 120 is provided at the panel second surface 106 for exposing the panel recess 118 through such surface 106. Even though the recess opening 120 may be sized to only partially expose the panel recess 118, it is preferred that the size of the opening 120 be substantially equivalent to that of the panel recess 118 so as to fully expose the panel recess 18 therethrough.

The upper member 115 may have a line aperture 112 formed through the upper member 115 with the line aperture 112 sized and configured to receive at least two air-conditioning lines 34 and 36. As shown in FIG. 10, the curved configuration of the lower member 116 of the hood member 108 permits the air-conditioning lines 34 and 36 to be passed through the line aperture 112 of the upper member without excessively bending the air-conditioning lines 34 and 36.

The cover 114 seals off the line aperture 112 of the upper member while allowing the air-conditioning lines 34 and 36 to pass therethrough. The cover 114 may have a first end 126 and a second end 128 with a barrier wall 130 disposed therebetween. A diameter of the first end 126 may be greater than a diameter of the second end 128. The first end 126 may be sized and configured to mate with the aperture 112 of the upper member 115. The barrier wall 130 may have a reducing diameter from the first end 126 to the second end 128. The barrier wall 130 and the second end 128 may be fabricated from a conformable material such that the cover 114 closely fits and seals off the aperture 112 of the upper member when the air-conditioning lines 34 and 36 are inserted therethrough. For example, the barrier wall 130 and the second end 128 may be fabricated from an elastomeric material. The second end diameter may be slightly smaller than an outer periphery of the bundled air-conditioning lines 34 and 36. In this manner, when the air-conditioning lines 34 and 36 are inserted through the aperture 112 of the upper member 115, the air-conditioning lines 34 and 36 slightly expand the second end 128 to form a close fit between the second end 128 and the air-conditioning lines 34 and 36.

Alternatively, the barrier wall 130 may be fabricated from a flexible material such as weather durable plastic, whereas, the second end 128 of the cover 114 may be fabricated from an elastomeric material. The air-conditioning lines 34 and 36 may be inserted through the aperture 132 of the upper member 115. The barrier wall 130 being fabricated from a flexible material flexes and bends to accommodate the air-conditioning lines 34 and 36. The second end 128 expands to permit the air-conditioning lines 34 and 36 to be inserted therethrough and conforms to the outer periphery of the bundled air-conditioning lines 34 and 36. This seals off the aperture 112 of the upper member from undesirable rodents and trash and air.

In operation, a user fastens the flashing panel mount 100 onto the selected exterior section of the building's wall 16 in a manner that its hood member 108 faces inside and the panel recess 118 is faced outside. The air-conditioning lines 34 and 36 are brought into the panel recess 118 through the aperture 112. Thereafter, the air-conditioning lines 34 and 36 are extended through the opening 120 of the second surface 106. The air-conditioning lines 34 and 36 are then connected to the air-conditioning unit or compressor located outside the residential and/or commercial building and connected therewith. The cover 114 is then conformed to the outer periphery of the bundled air-conditioning lines 34, 36 to seal off the opening 112.

Figure 11:
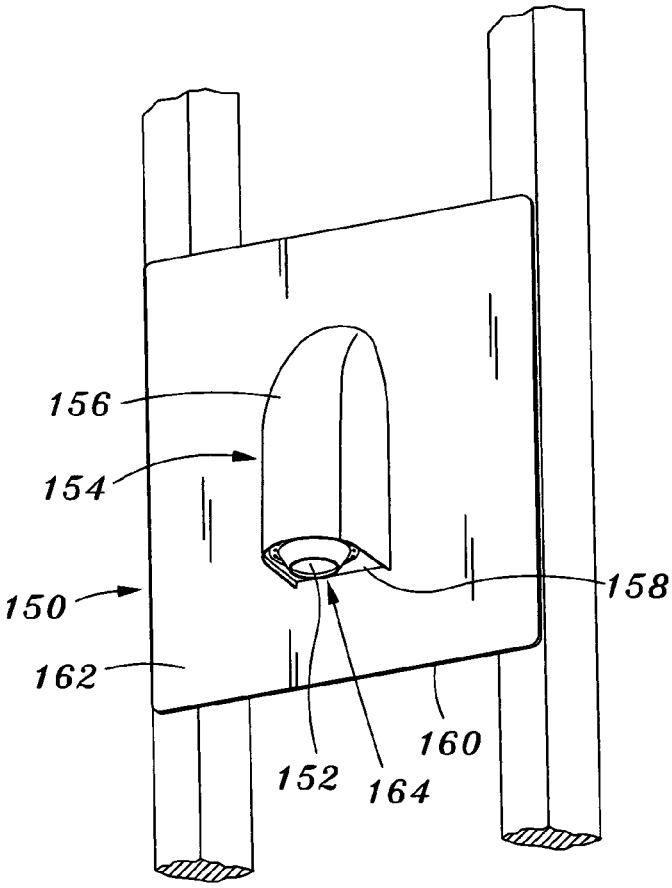
FIG. 11 is a perspective view of an air conditioning flashing panel mount constructed in accordance with a fourth preferred embodiment of the present invention and illustrating a hood member which extends out toward the exterior of the building and a plurality of air conditioning lines extending through one aperture formed at the lower member of the hood member.

Referring now to FIG. 11, there is further provided an air conditioning flashing panel mount 150 which is constructed in accordance with a fourth embodiment of the present invention. The flashing panel mount 150 of the fourth embodiment is designed to perform the identical function as that of the first through third embodiments. However, its structure and manner of use are slightly modified in comparison thereto.

In particular, in contrast to the first and second embodiment, the air conditioning lines 34, 36 are not separated and inserted through respective apertures 32 and 86. The flashing panel mount 150 of the fourth embodiment is similar to the third embodiment in that the air conditioning lines 34, 36 are bundled and fed through a single line aperture 152. However, the flashing panel mount 150 of the fourth embodiment is different from the third embodiment in that the hood member 154 has a reversed configuration. In the fourth embodiment, the line aperture 152 is not formed in the upper member 156. Rather, the line aperture 152 is formed in the lower member 158. Also, the hood member 154 extends away from the building, and the second surface 160 of the panel 162 is attached to the wall 16.

The flashing panel mount 150 of the fourth embodiment also has a cover 164 which conforms about the outer periphery of the bundled air conditioning lines 34, 36 to prevent entry of unwanted rodents, trash or air into the building. The cover 164 may have the same configurations and alternative configurations as the cover 114 discussed in relation to the third embodiment.

To install the flashing panel mount 150, the second surface 160 of the panel 162 is placed in contact with the wall 16. The lower member 158 which is formed with the line aperture 152 is directed toward the ground, and the hood member 154 extends away from the building. The air conditioning lines 34, 36 are brought through the recess of the hood member 154 through the second surface 160 of the panel 162. Thereafter, the lines 34, 36 are fed through the aperture 152 of the lower member 158 and the cover 164. The cover 164 conforms to the outer periphery of the bundled air conditioning lines 34, 36 to prevent entry of undesirable rodents, trash and air. Rain is also prevented from entering the building. In particular, the rain falls on the panel 162 or the exterior surface of the upper member 156 and cascades down onto the ground bypassing the lower member 158.

Additional modifications and improvements of the present invention may also be apparent to those of ordinary skill in the art. Specifically, those of ordinary skill will recognize that the electrical control line may additionally be brought through one of the refrigerant line apertures thereby eliminating the need for a preferred separate electrical control line aperture formed in the panel mount. Thus, the particular combination of parts described and illustrated herein is intended to represent only certain embodiments of the present invention, and is not intended to serve as limitations of alternative devices within the spirit and scope of the invention.

What is claimed is:

1. A flashing panel mount for routing a plurality of refrigerant lines of an air conditioning unit located about an exterior of a building through a hole in a side wall of the building wherein the hole is formed above grade, the plurality of refrigerant lines defining an outer periphery, the panel mount comprising:

a hood member attachable to the side wall of the building, the hood member having a hood member aperture sized and configured to accommodate the plurality of refrigerant lines and aligned to the side wall hole so as to permit extension of the refrigerant lines from within the building through the building side wall above grade to the air conditioning unit located about the building exterior; and a cover attached to the hood member and is disposed under the hood member, the cover having an aperture, the cover aperture defining an inner periphery smaller than the outer periphery of the plurality of refrigerant lines, the cover being fabricated from elastic material such that the inner periphery of the cover aperture enlarges and conforms to the outer periphery of the plurality of refrigerant lines when the plurality of refrigerant lines are inserted through the cover aperture to generally seal the cover aperture against the outer periphery of the plurality of refrigerant lines and prevent entrance of undesirable material from the building exterior to a building interior through the hole of the building wall;

wherein the cover and the hood member are sized and configured to route the plurality of refrigerant lines through the flashing panel mount in a generally downward direction to the ground.

2. The flashing panel mount of claim 1 wherein the cover aperture conforms to a portion of the outer periphery of the plurality of refrigerant lines when the plurality of refrigerant lines are inserted through the cover aperture.

3. The flashing panel mount of claim 1 wherein the cover is fabricated of rubber.

4. The flashing panel mount of claim 1 wherein the cover is disposed within a recess of the hood member such that falling rain bypasses the cover, cascades off of the hood member and falls on the ground.

5. The flashing panel mount of claim 1 wherein the cover is positioned in the recess of the hood member such that the cover is generally in shade during the day.

6. The flashing panel mount of claim 1 wherein the cover is positioned in the recess of the hood member such that the entire cover is generally in shade during the day.

7. The flashing panel mount of claim 1 wherein the cover is disposed underneath the hood member for protecting the cover from degradation due to rays of sun and oriented for routing the plurality of refrigerant lines downward.

8. A flashing panel mount for routing a plurality of refrigerant lines of an air conditioning unit located about an exterior of a building through a hole in a side wall of the building, the plurality of refrigerant lines defining an outer periphery, the flashing panel mount comprising:

a hood member alignable to the side wall hole and attachable to the side wall of the building, the hood member having a hood member recess sized and configured to accommodate the plurality of refrigerant lines to permit extension of the plurality of refrigerant lines from within the building through the building side wall to the air conditioning unit located about the building exterior; and an elastic cover attached to the hood member and positioned within the recess to protect the cover from degradation due to UV rays from a sun during day time.

* * * * *